United States Patent [19]

Blanckmeister

[11] 4,300,568

[45] Nov. 17, 1981

[54] THERAPEUTIC BRA

[76] Inventor: Charles Blanckmeister, 88-48 74th Pl., Woodhaven, N.Y. 11421

[21] Appl. No.: 42,985

[22] Filed: May 25, 1979

[51] Int. Cl.[3] ..... A41C 3/00

[52] U.S. Cl. ..... 128/509

[58] Field of Search ..... 128/509, 510; 2/DIG. 6

[56] References Cited

U.S. PATENT DOCUMENTS

| | | | |
|---|---|---|---|
| 2,156,478 | 5/1939 | Kemp | 128/509 |
| 2,521,373 | 9/1950 | Hutchison | 128/509 |
| 3,009,235 | 11/1961 | Mestral | 2/DIG. 6 |
| 3,164,844 | 1/1965 | Ruby | 2/DIG. 6 |

FOREIGN PATENT DOCUMENTS

| | | | |
|---|---|---|---|
| 1374231 | 10/1964 | France | 2/DIG. 6 |

*Primary Examiner*—Doris L. Troutman

*Attorney, Agent, or Firm*—Richard L. Miller

[57] ABSTRACT

A brassiere designed particularly for being easily put on by partly incapacitated persons; and including (instead of hooks and eyes at the rear ends for attachment together), a long draw tape connected to one end and pulled through rings on both ends, the end of the draw tape having a loop for pulling by a person's finger and also a VELCRO pad attachable selectively to several VELCRO pads located around the periphery of the bra.

1 Claim, 2 Drawing Figures

Fig. 1
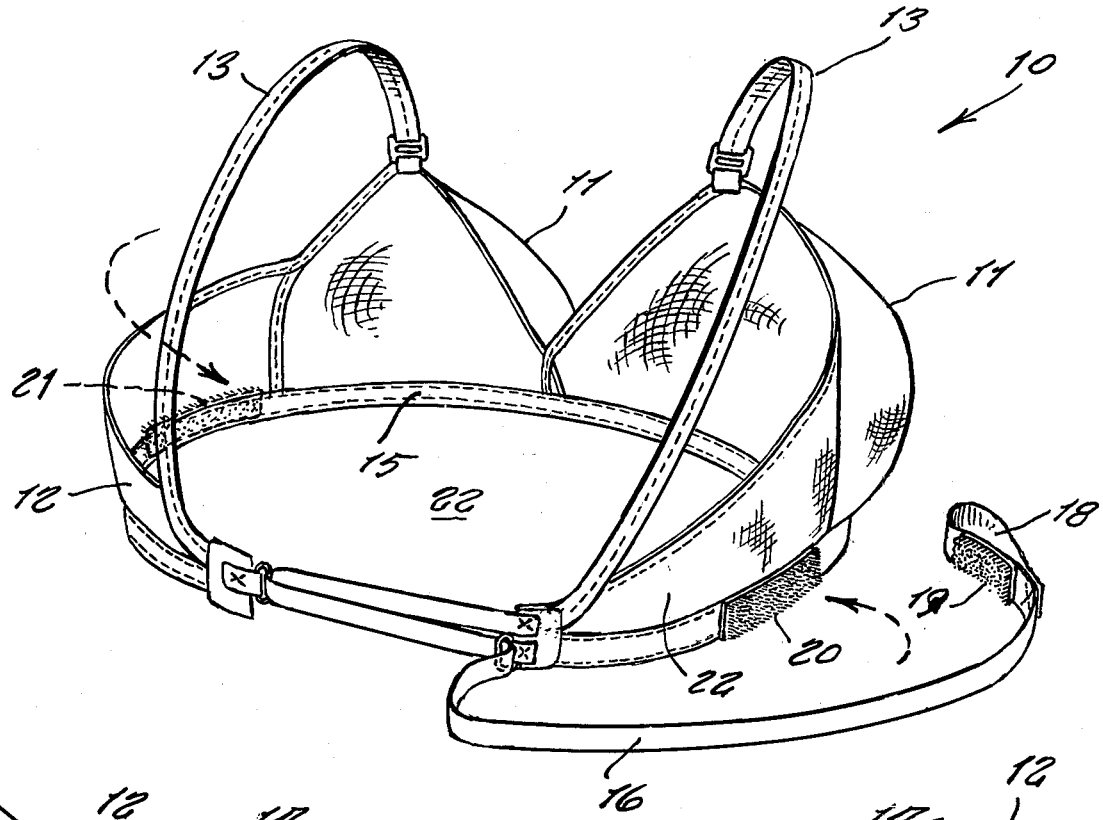
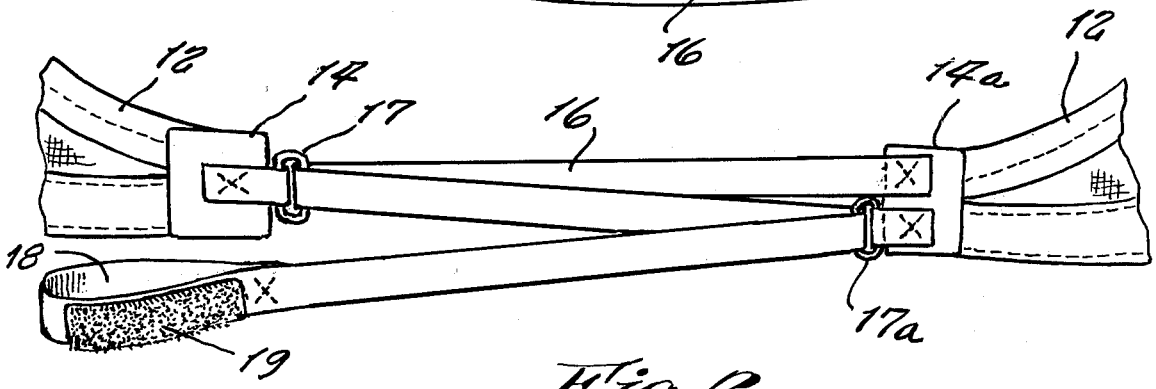
Fig. 2

THERAPEUTIC BRA

BACKGROUND OF THE INVENTION

This invention relates generally to women's bras.

It is well known that a great many women who are partly incapacitated physically, such as from arthritis, bursitis, Parkinson's disease, rheumatism or by a stroke, find it difficult to put on clothing that requires moving their arms for reaching into various positions or moving their fingers so as to close snap fasteners or buttons. One such garment not easy for such persons to put on or take off, is a woman's bra, which necessitates both arms to reach behind themselves and fingers to attach hooks and eyes at that position. This situation is, accordingly, in need of an improvement.

SUMMARY OF THE INVENTION

Therefore, it is a principal object of the present invention to provide a therapeutic bra which is designed for easily being put on or removed, by physically partly incapacitated persons.

Another object is to provide a therapeutic bra which does not require reaching behind a person or use of finger tips so as to connect hooks and eyes together, but can be put on or off by anyone who can at least bring one hand to an opposite side, and has at least enough finger dexterity so as to pull on a loop.

Still another object is to provide a therapeutic bra which is also ideal for other persons who find it difficult to reach or work a bra closure such as very stout persons or the like.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

The Figures on the drawings are briefly described as follows:

FIG. 1 is a rear perspective view of the invention.

FIG. 2 is a fragmentary rear view shown enlarged.

DETAILED DESCRIPTION OF PREFERRED EMBODIMENT

Referring now to the drawing in greater detail, the reference numeral 10 represents a therapeutic bra according to the present invention, wherein there are a pair of breast cups 11 adjacent to each other, and each cup being connected to a tab 12 for extending around to a rear side of a person. A pair of shoulder straps 13 each extends between an upper end of one of the cups and one end 14 or 14*a* of the tabs. A tape 15 is stitched along a lower edge of the cups and the tabs.

In the present invention, a long draw tape 16 is stitched at one end to one of the tab ends 14*a*, the tape 16 then being pulled through rings 17 and 17*a* fastened to the tab ends 14 and 14*a*. The opposite end of the long draw tape is made with a loop 18 into which a user can insert a finger so as to pull the tape. A VELCRO pad 19 affixed to one outer side of the loop, the VELCRO pad 19 being selectively engageable either with a VELCRO pad 20 or 21 mounted on outer opposite sides of the tape 16 so as to be at each side of a wearer where they can be easily reached by a hand without stress.

In operative use, the VELCRO pads 19 and 20 are just attached together, so that the bra central opening 22 is large, making the bra in a fully expanded condition, and the bra can be comfortably either pulled over a head or stepped in. After being pulled into position around the bust, the loop 18 is then pulled so as to detach the VELCRO pads 19 and 20, and the draw tape is then pulled, thus drawing the bra into a snug fit around the body, the VELCRO pad 19 then being secured to the VELCRO pad 21.

The bra can be manufactured for either a right or left hand use, depending on which side of a person may be disabled.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A therapeutic bra, comprising, in combination, a pair of breast cups adjacent to each other, a tab adjacent a side of each said cup for extending around a back of a wearer and having rings at their ends, a pair of shoulder straps between each said cup and an end of each said tab, a lower edge tape stitched along a lower edge of said cups and tabs, and a single draw tape for drawing said tab ends toward each other; said draw tape being of relatively long length and attached at its one end to one said tab end; said relatively long draw tape being laced through said rings on each of said tab ends so that said tabs may be permanently tied together, a loop-pile fastener element on an opposite end of said draw tape being selectively engageable with co-operating loop-pile fastener elements on said lower edge tape.

* * * * *